US008247742B2

(12) United States Patent
Searle et al.

(10) Patent No.: US 8,247,742 B2
(45) Date of Patent: Aug. 21, 2012

(54) QUARTZ TUBE INFRARED HEATER SYSTEM

(75) Inventors: Bruce R. Searle, Rainier, WA (US); Hen Yuan Lin, Panchiao (TW)

(73) Assignee: Acepower Logistics, Inc., Taipei (TW)

( * ) Notice: Subject to any disclaimer, the term of this patent is extended or adjusted under 35 U.S.C. 154(b) by 496 days.

(21) Appl. No.: 12/450,856

(22) PCT Filed: May 6, 2008

(86) PCT No.: PCT/US2008/005786

§ 371 (c)(1),
(2), (4) Date: Oct. 14, 2009

(87) PCT Pub. No.: WO2008/140700

PCT Pub. Date: Nov. 20, 2008

(65) Prior Publication Data

US 2011/0100971 A1 May 5, 2011

Related U.S. Application Data

(60) Provisional application No. 60/928,692, filed on May 11, 2007.

(51) Int. Cl.
*A21B 1/22* (2006.01)

(52) U.S. Cl. ..... 219/408

(58) Field of Classification Search ..... 219/406–412, 219/483, 504
See application file for complete search history.

(56) References Cited

U.S. PATENT DOCUMENTS

| | | | | |
|---|---|---|---|---|
| 3,575,582 | A | 4/1971 | Covault | |
| 3,740,527 | A | 6/1973 | Roffelsen | |
| 5,511,145 | A * | 4/1996 | Bailey et al. | 392/355 |
| 7,046,918 | B1 * | 5/2006 | Burkett et al. | 392/375 |
| 2006/0110141 | A1 | 5/2006 | Burkett et al. | |

* cited by examiner

*Primary Examiner* — Calvin Lee
(74) *Attorney, Agent, or Firm* — Brian J. Coyne

(57) ABSTRACT

An electric space heating system Air at ambient temperature is drawn by a fan assembly into the system through an air inlet filter, then moves through a "Z"-shaped box within a heat exchanger assembly where it is heated by quartz heater tube assemblies The heated air is further heated as it passes by copper plates within the box and then exits the system Each tube assembly includes an electrically-resistive filament within the lumen of a quartz tube that is translucent to Infrared radiation emitted by the filament Oppositely—directed, ceramic insulators, attached to opposite ends of the tube, in combination with a ceramic, electrical connector block, support the tubes within the box and provide electrical contacts for an electric power source to energize the filament The block has a spring-loaded, sliding electrical contact that facilitates installation and removal of the tube assemblies through a utility access cutout.

21 Claims, 14 Drawing Sheets

QUARTZ TUBE INFRARED HEATER SYSTEM

CROSS REFERENCE TO RELATED APPLICATIONS

This application claims the benefit of a provisional application by the same applicants for the same invention filed in the United States Patent and Trademark Office on May 11, 2007, application Ser. No. 60/928,692.

STATEMENT REGARDING FEDERALLY APPROVED RESEARCH OR DEVELOPMENT

None.

APPLICANTS: Bruce R. Searle and Hen Yuan Lin

BACKGROUND OF THE INVENTION

1. Field of the Invention

This invention relates generally to electric space heater systems, and in particular to electric space heater systems that employ quartz tubes to emit infrared radiation in order to heat air as it passes through the systems. The invention provides a safe, energy efficient space heater, comprising an outer beauty box that houses a heat exchanger, an air inlet filter, and electronic controls and L.E.D. display.

2. Description of the Related Art

Room heaters, including portable room heaters, have been characterized by their energy inefficiencies, high heat cost, high-oxygen consumption, and their potential to create fire hazards. Most units use heat sources like halogen tubes, air contact with flame and electric resistance coils, each of which have one or more of these undesirable characteristics. The following U.S. patents are known in the art and are incorporated by reference herein: U.S. Pat. Nos. 3,575,582; 3,777,728; 4,052,593; 4,164,642; 4,197,447; 4,307,284; 4,309,594; 4,680,448; 4,835,367; 5,013,893; 5,157,239; 5,568,586; 5,954,980; 5,990,460; 6,041,994; 6,327,427B1.

SUMMARY OF THE INVENTION

Accordingly, there remains a need to overcome the above-described disadvantages of the previously known room heaters.

It is, therefore, an object of this invention to provide an electrically-powered, room air heater system that is portable so that it can be placed at any convenient location in a room and can easily be moved about from place to place.

It is another object of this invention to channel room air that is drawn into the system along a "Z"-shaped airstream pathway.

It is a further object of this invention to provide a system to heat room air by infrared radiation emitted by quartz heater tube assemblies within the "Z"-shaped airstream pathway.

Another object of this invention is to provide a utility access opening that permits easy installation and removal of the quartz heater tube assemblies.

It is still another object of this invention for each quartz tube assembly to include apparatus for creating turbulence in the air as it passes by said assembly in order to enhance the energy efficiency of the system, said apparatus preferably being a helical, stainless steel fin having a plurality of helically-spaced depressions.

Another object of this invention is to include at least one copper plate within or adjacent to the "Z"-shaped airstream pathway to further heat the air, thereby further enhancing the energy efficiency of the system.

Still another object of this invention is to provide such a system that does not consume room oxygen or room air moisture.

A further object of this invention is to provide such a system that, even while heating air, has exterior surfaces that remain cool to the touch.

These and other objects of the invention will become apparent from the figures and detailed description of the invention.

The invention provides a system for heating air, said system comprising an air inlet end through which air that is to be heated can enter into the system, and an air outlet end through which air that has been heated by the system can exit the system. A heat exchanger assembly is interposed between, and in communication with, the air inlet end and the air outlet end. Duct means conducts air through the heat exchanger assembly from the inlet end to the outlet end, thereby defining a "Z"-shaped airstream path for the flow of air through the system. One or more quartz heater tube assemblies are laterally disposed with respect to the airstream path within the duct means. Within each quartz heater tube assembly is a quartz tube that is translucent to infrared radiation. Within the lumen of each tube is an electrically-resistive filament that emits infrared radiation when electrical current is passed through the filament, which filament is preferably a helical coil of resistive wire, such as NICHROME®. Attached to opposite ends of each tube are first and second ceramic insulators. Each ceramic insulator includes electrical contact means by which electric power means, included in the system, can supply electric current to the filament. Means is provided for mounting the ceramic insulators to the heat exchanger assembly such that the tubes are disposed laterally with respect to the airstream pathway. Each quartz heater tube assembly further includes means surrounding the tube for inducing air turbulence in the vicinity of the tube when the system is energized and operating; in the preferred embodiment, said means includes a helical, stainless steel fin having a plurality of helically-spaced depressions, which fin is coaxial with, and wound about, the tube and has opposite ends attached to the ceramic insulators. By disturbing the air as it passes over the quartz heater tube assemblies, the fins improve the heating efficiency of the system. Means is provided for drawing air into, through, and out of the system, which means preferably includes an electric fan assembly disposed adjacent to the air inlet end of the system and wired to the electric power means.

In a preferred embodiment, the duct means includes a "Z"-shaped, hollow box that houses said tubes. The "Z"-shaped box has an entrance opening adjacent to and in communication with the fan assembly and an exit opening adjacent to and in communication with the air outlet end of the system, and the box a first, left side and a laterally spaced-apart second, rights side, and a plurality of interior surfaces that in combination define a "Z"-shaped airstream pathway. The second side has a utility access cutout to permit easy installation and removal of quartz heater tube assemblies. The interior surfaces of the "Z"-shaped box include at least one air deflector surface interposed between the quartz tubes and the fan assembly to shield the fan assembly from direct infrared radiation from the tubes.

In a preferred embodiment, the first and second ceramic insulators have oppositely-directed first and second shank extensions, respectively, and electrically-conductive shank extension contacts are embedded within said first and second shank extensions, respectively, each shank extension contact having a first end attached to the electrical filament and an opposite, second end. More particularly, each shank extension contact comprises an electrically-conductive, contact pin, and oppositely-directed first ends of the pins are connected to opposite ends of the filament. For mounting the quartz heater tube assemblies within the "Z"-shaped box, the first side of the box has four circular tube mount openings, and the second side of the box has a corresponding second set of four, circular tube mount openings that are laterally and oppositely-disposed with respect to the first set of openings. A ceramic electrical connector block is provided for each quartz heater tube assembly. Each block includes a body that comprises a socket portion and an oppositely-directed mounting portion. The body has a bore that extends through the socket and mounting portions. The socket portion is adapted to receive a shank extension of a first ceramic insulator. The mounting portion is dimensioned to be insertable into, and supported by, any one of the first tube mount openings. Within the bore is a spring stop and a slidable, electrical contact that is movable between a retracted position and an extended position within the bore. A compression spring is interposed between the slidable contact and the spring stop, which spring urges the slidable contact toward the extended position. An electrical male connector tab has a first end disposed within the bore of the block and attached to the slidable contact, and has an opposite, second end that includes a tab extension adapted for insertion into a female electrical wire connector. For mounting the second, opposite end of a quartz tube assembly within the "Z"-shaped box, four apertured mounting plates are provided, and each mounting plate is attachable by a pair of screws to cover one of the tube mount openings on the second side. The shank extensions of the second ceramic insulators are insertable into the apertures of the mounting plates. Thus, for mounting a quartz heater tube assembly within the system, with a mounting plate removed to thereby uncover a tube mount opening in the second side, the assembly is passed through the utility access cutout and through the tube mount opening. The first ceramic insulator of the quartz heater tube assembly is pressed against a block mounted opposite on the first side to cause the slidable contact to retract and the block compression spring to compress. The shank extension of the first ceramic insulator is then inserted into an aperture in the mounting plate and the mounting plate is attached to an exterior surface of the second side by a pair of screws. The second ends of the pins are then connected by wires to the electric power means. A quartz heater tube assembly can be removed from the system by reversing these steps.

The system includes a control panel for turning the system on and off and for temperature and time settings. The system further includes a beauty box with a finished exterior appearance that surrounds the heat exchanger, except the bottom side thereof, and remains cool to the touch even while the system is in heating mode.

Figure 1:
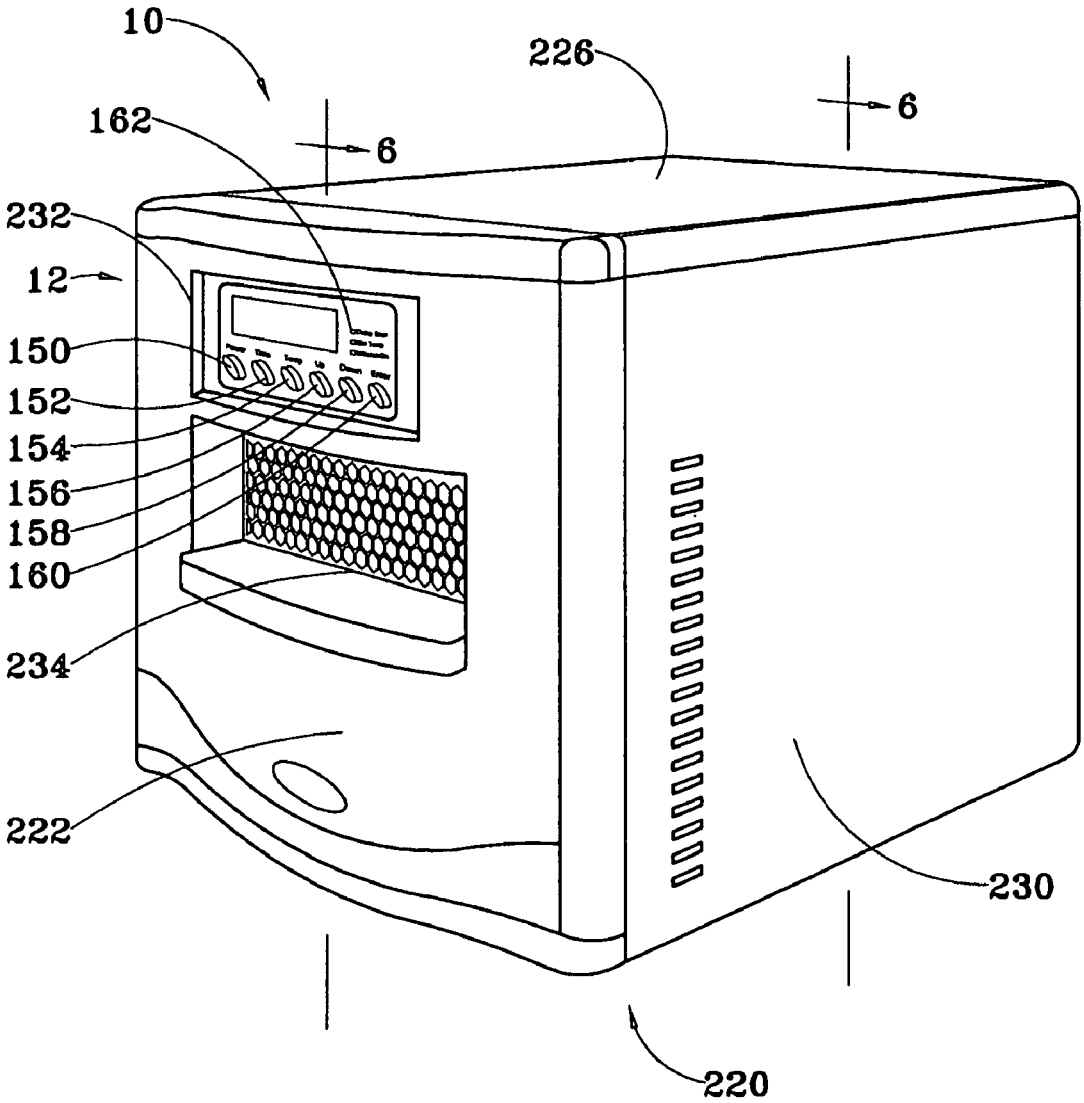
FIG. 1 is a front, right perspective view of a preferred, portable embodiment of the space heater system of the present invention.
Figure 2:
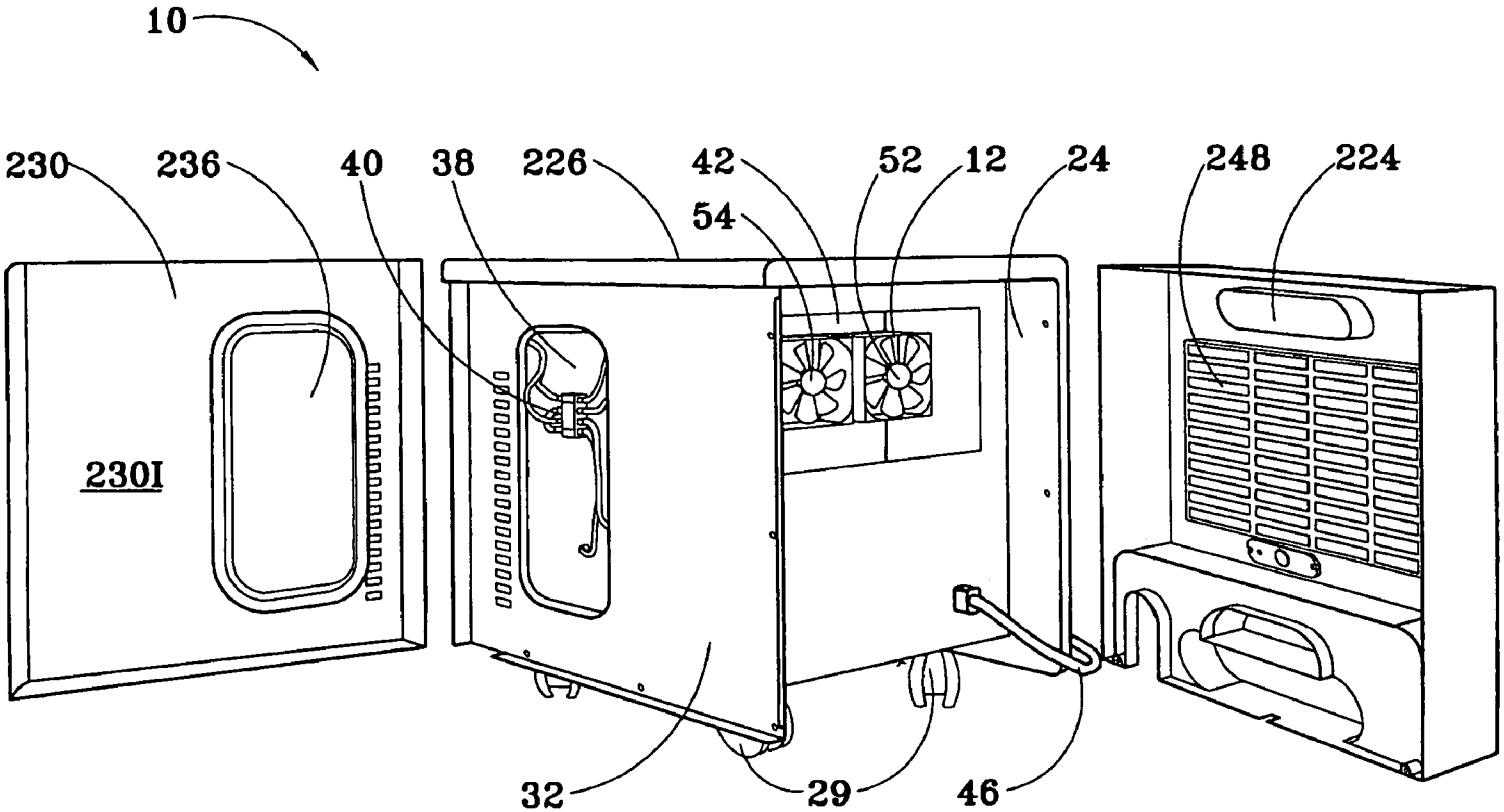
FIG. 2 is rear perspective view thereof, showing the right side panel and the rear panel of the beauty box removed to reveal the right side and rear side of the heat exchanger assembly.

Similar numerals designate similar component parts of the system throughout the several views. The terms "left," "right," "front" and "rear" denote the orientation of the system as depicted in FIG. 1, wherein "left" and "right" correspond to the left and right sides of said figure, and "front" and "rear" correspond to the front and rear areas of said figure.

DETAILED DESCRIPTION OF A PREFERRED EMBODIMENT

A preferred embodiment of the present invention, denoted generally by the numeral 10 and intended for use as a portable space or room heating system, will now be described. The system 10 has an air inlet end 12, an air outlet end 14, and a heat exchanger assembly, denoted generally by the numeral 16, interposed between, and in communication with, the air inlet and outlet ends. The heat exchanger assembly 16 has front and rear sides 22, 24, joined by a top side 26, bottom side 28, left side 30 and right side 32, which sides are preferably made of sheet metal, thereby defining a substantially enclosed space. For mobility, four caster wheels 29 are attached to the bottom side 28. The top side 26 is folded about a front margin 26M to form a vertical, recessed flange 26F, and the front side 22 is folded about an upper margin 22M to form a horizontal flange 22F in mating engagement with the flange 26F. A control panel 36 is attached by screws (not shown) inserted through spacers 37S to the recessed flange 26F and is connected to wires 36W that extend through a pair of laterally spaced-apart, wire pass-through apertures 39 in said flange. The front side 22 has an air outlet cutout 23 that is covered by a child-proof, air outlet grill 25. The right side 32 has a utility access cutout 38 that permits manual access to electrical and electronic components for maintenance and repair of the system. The rear side 32 has an air inlet cutout 42 at the air inlet end 12 and an electric power pass-through opening 44 through which a 3-wire power cord 46 supplies a.c. power to the system. A fan assembly 50 is mounted within the heat exchanger assembly 16 adjacent to the air inlet cutout 42 and preferably includes two, laterally spaced-apart, electric fans 52, 54 for drawing room air at ambient temperature into the system 10 whenever the system is energized and operating.

Figure 6:
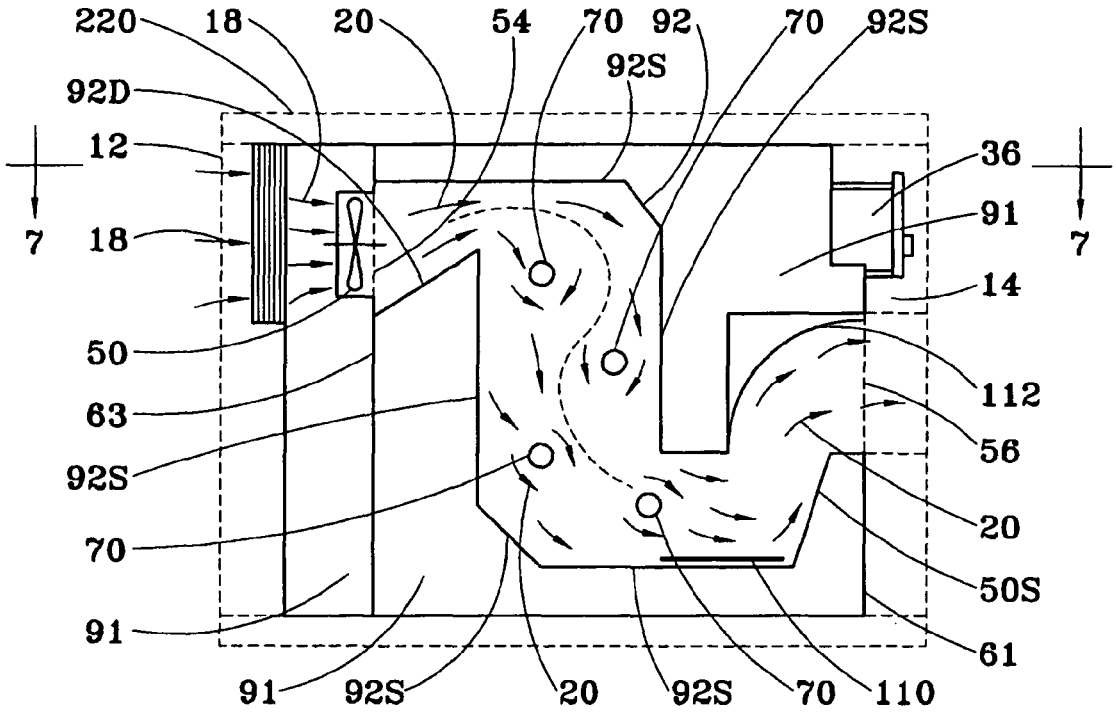
FIG. 6 is a vertical cross-sectional, schematic view through the beauty box, heat exchanger assembly, and "Z"-shaped box thereof, taken along line 6-6 of FIG. 1.
Figure 7:
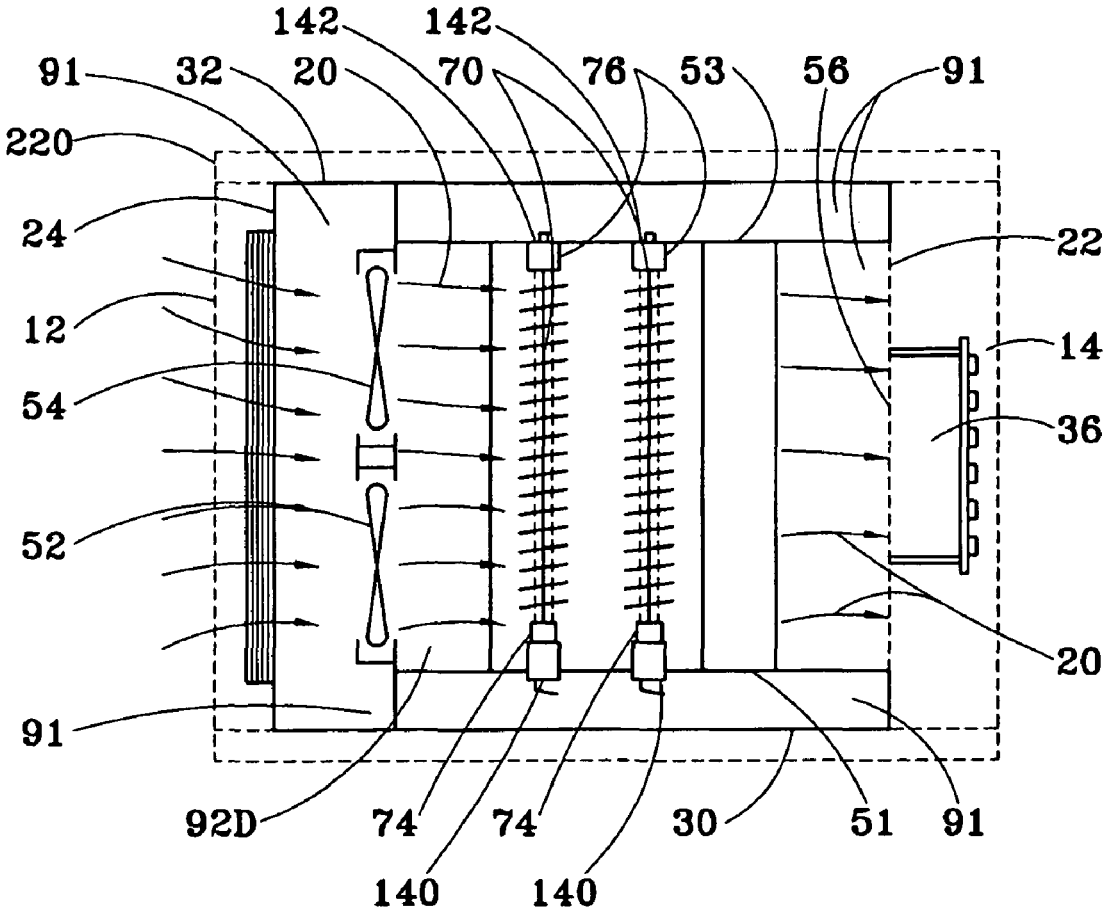
FIG. 7 is a horizontal cross-sectional view through the beauty box and heat exchanger assembly thereof, taken along line 7-7 of FIG. 6.
Figure 8:
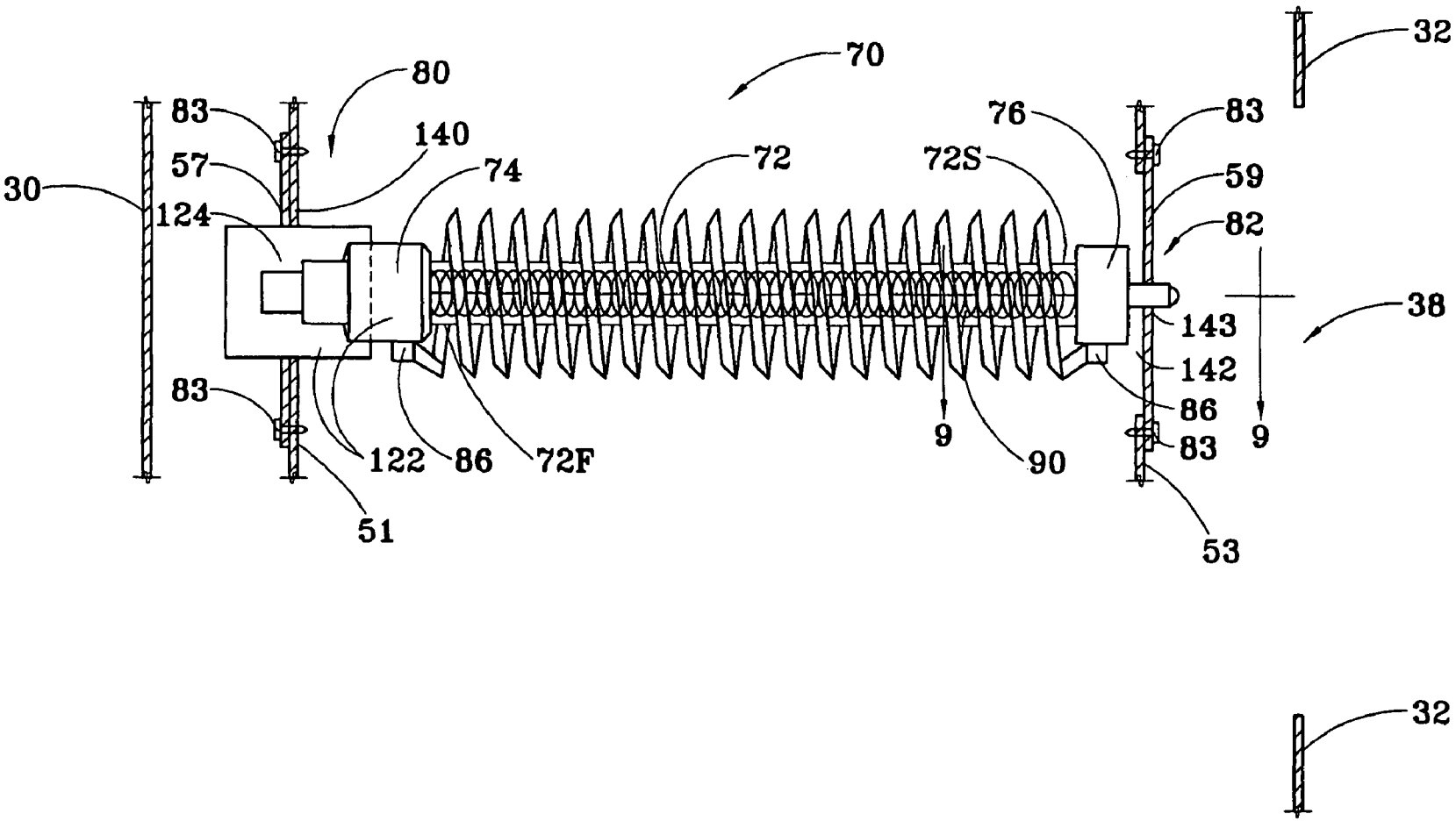
FIG. 8 is an enlarged, front elevational view of a quartz tube mounted between retaining plates within the heat exchanger thereof.
Figure 9:
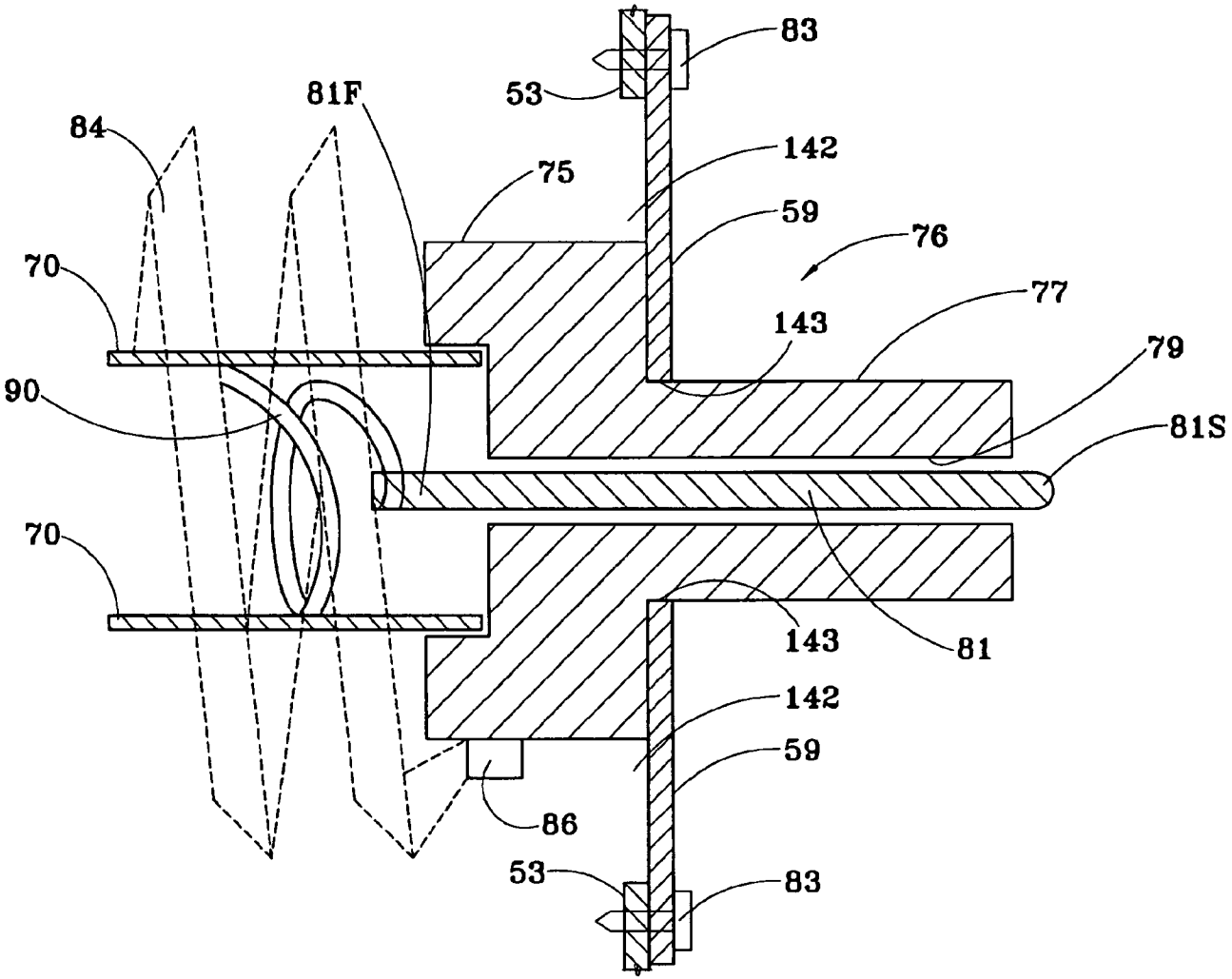
FIG. 9 is a further enlarged, vertical cross-sectional view of a first end of the quartz tube inserted into a first ceramic insulator thereof, taken along line 9-9 of FIG. 8.
Figure 10A:
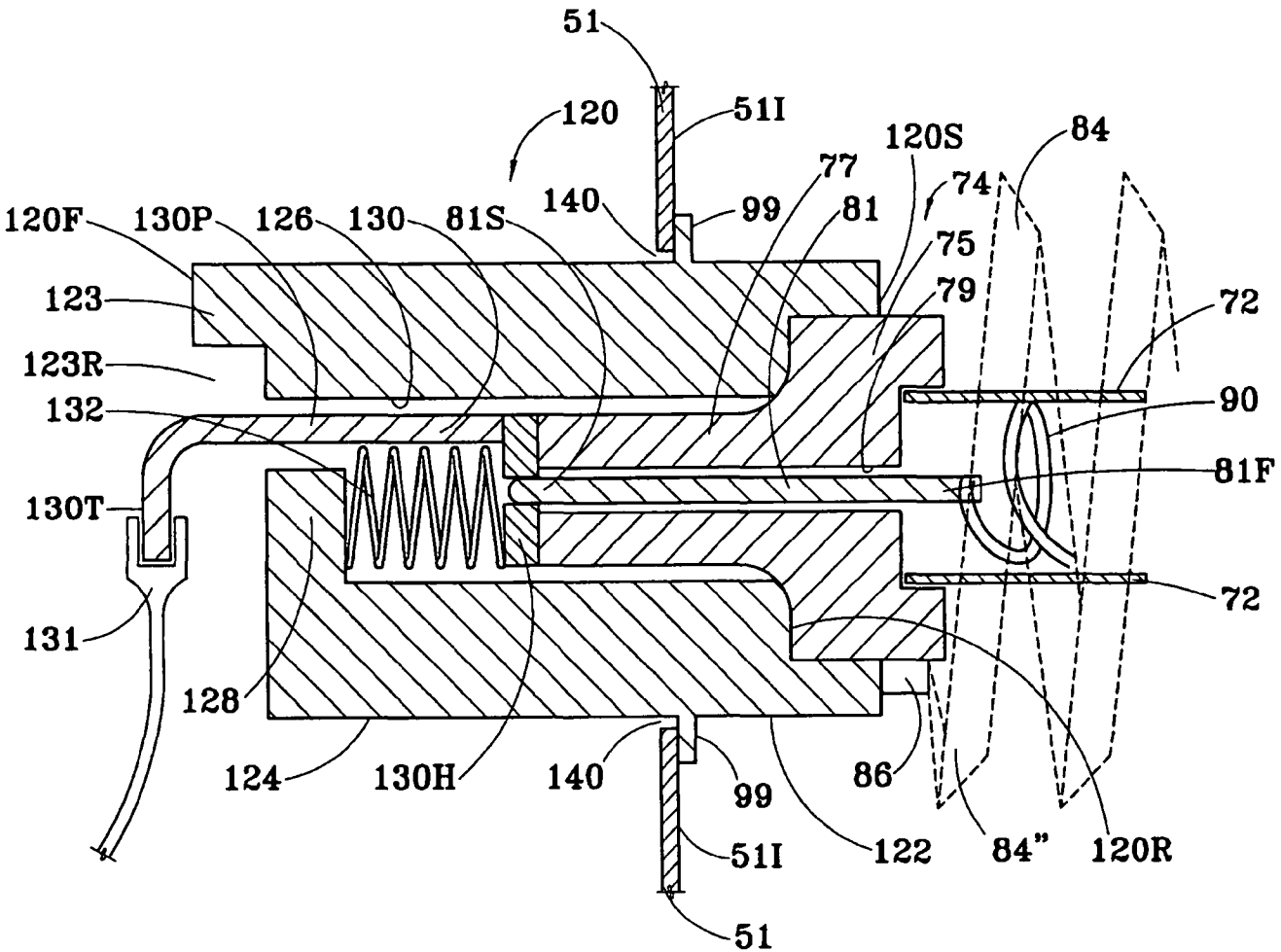
FIG. 10A is a further enlarged, vertical cross-sectional view of a second end portion of the quartz tube inserted into a second ceramic insulator, and of an electrical connector block into which a mounting portion of the second ceramic insulator has been inserted, taken along line 10-10 of FIG. 8, and the sliding contact in a retracted position.
Figure 10B:
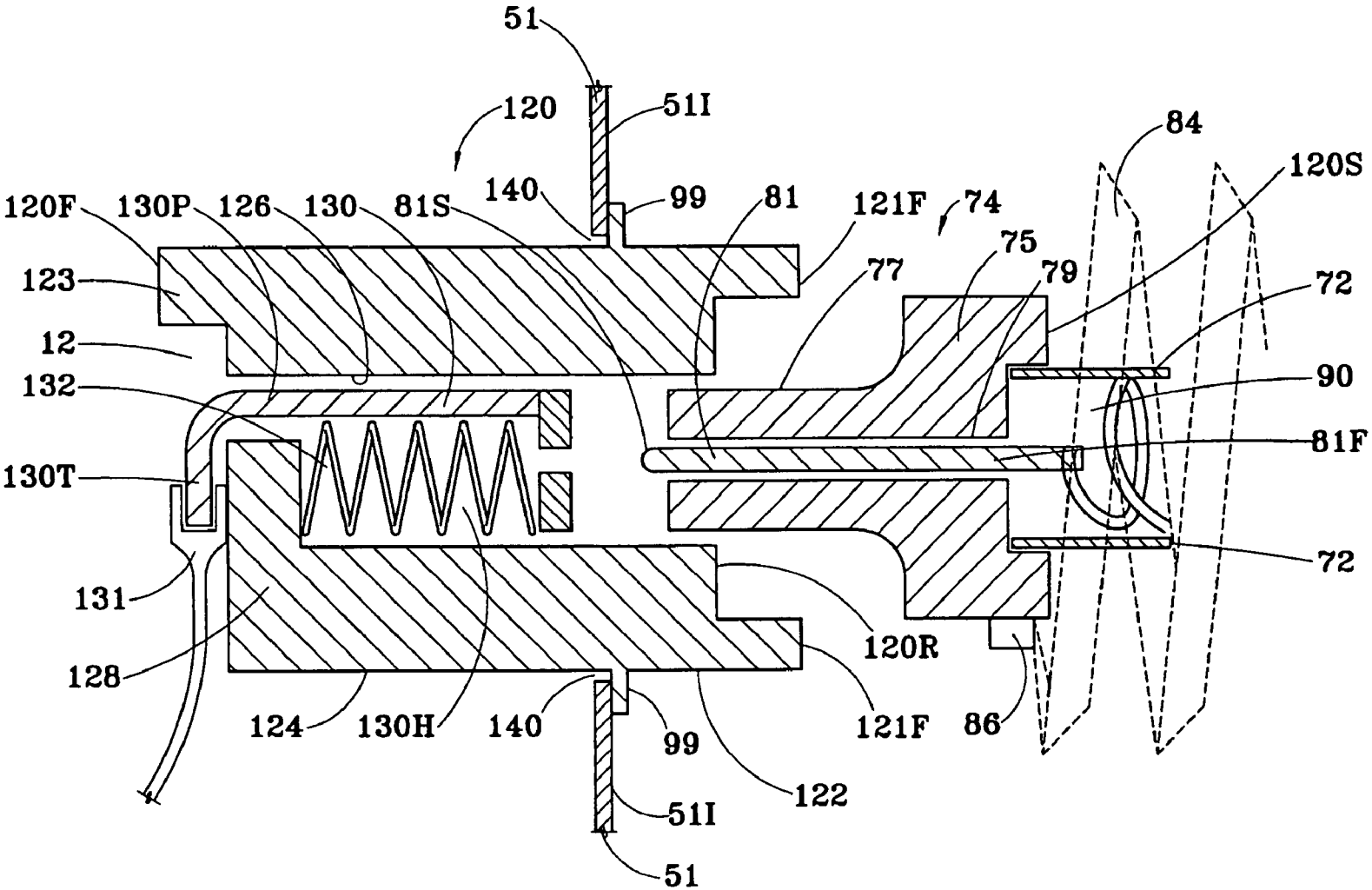
FIG. 10B is the same view as FIG. 10A, but with the second end portion of the quartz tube withdrawn from the second ceramic insulator and the sliding contact in an extended position.

The heat exchanger assembly 16 also includes duct means for conducting inlet air (arrows 18) from the air inlet end 12, through the system and out the air outlet end 14, as may best be seen in FIG. 6. The duct means includes a "Z"-shaped, hollow box 92 that has an entrance opening 54 adjacent to and in communication with the fan assembly 50 and an exit opening 56 adjacent to and in communication with the outlet grill 25 at the air outlet end 14 of the system. The box 92 has a first, left side 51 and a second, right side 53 joined by a front side 61, a rear side and a plurality of interior surfaces 92S that in combination define a "Z"-shaped, airstream pathway, denoted by arrows 20. Four quartz heater tube assemblies 70 for providing infrared heat are disposed laterally with respect to the airstream pathway 20 within the box 50. The interior surfaces 92S include an air deflector surface 92D interposed between the quartz heater tube assemblies 70 and the fan assembly 50 to shield the fan assembly from direct infrared radiation from the quartz heater tube assemblies. To enhance the heating efficiency of the system, first and second copper plates 110, 112 are attached to opposite interior surfaces 92S of the box 92 near the air outlet end 14.

Referring to FIGS. 6-12, each quartz heater tube assembly 70 includes a quartz tube 72 that is translucent to infrared radiation. Opposite first and second ends 72F, 72S of the quartz tube 72 are received within, attached to, and supported by, oppositely-directed, first and second ceramic insulators 74, 76, which insulators include first and second electrical contact means 80, 82, respectively. An electrical filament 90 in the form of an electrically-resistive, helical coil extends through the lumen of the tube 72 from the first electrical contact means 80 to the second electrical contract means 82; whereby, when the filament is energized by the passage of electric current therethrough as supplied by electric power means 100 wired to the electrical contact means 80, 82, the filament heats up and emits infrared radiation out of the tube and into the airstream path 20. The first and second ceramic insulators 74, 76 each comprise a cylindrical body portion 75 and, coaxial with said body, a cylindrical, reduced-diameter shank extension portion 77. Each of the insulators 74, 76 has an axial bore 79 therethrough into which is inserted an electrically-conductive, contact pin 81. Each contact pin 81 has opposite first and second ends 81F, 81S. The first end 81F of each contact pin 81 protrudes through the bore 79 into the lumen of the tube 72. The second end 81S of each contact pin 81 protrudes through the bore 79 and beyond the shank extension 77 in which it is embedded. Thus, except for the first and second ends 81F, 81S thereof, each pin 81 is rigidly embedded within a shank extension 77. Opposite ends of the filament 90 are attached by pressed contact clips (not shown) to the first ends 81F of the pins 81.

An electrical connector block 120 is provided for mounting each quartz heater tube assembly 70 within the "Z"-shaped box 92 and for providing electrical current connections to the second ends 81S of the pins 81. The block 120 has a substantially cylindrical body that extends from a first end 120F to an opposite, second end 120S and comprises a mounting portion 124 at the first end thereof and a coaxial, oppositely-directed mounting portion 122 at the second end thereof. An annular flange 99 surrounds the socket portion 122 and abuts against an interior surface 511 of the left side 51 of the "Z"-shaped box 55. An axial bore 126 extends through the socket and mounting portions 122, 124. The second end 120S has a cylindrical recess 120R dimensioned to receive the shank extension 77 of the first ceramic insulator 74. Near the first end 120F a spring stop 128 extends into the bore 126. A sliding, electrical contact 130, is movable within the bore 126 between a retracted position, depicted in FIG. 10A, and an extended position, depicted in FIG. 10B, wherein the retracted position is achieved by pressing the shank extension 77 of the second ceramic insulator 76 against a head portion 130H of the sliding contact 130. The slidable contact 130 is urged toward the first end 120F by a block compression spring 132 interposed between the stop 128 and the head portion 130H of the sliding contact. The sliding contact 130 further includes a tab portion 130T adapted for insertion into a female wire connector 131. The tab portion 130T is joined to the head portion 130H by a plate portion 130P. The first end 120F of the block 120 has a rectangular recess 123R to accommodate reciprocating movement of the tab portion 130T.

Figure 11:
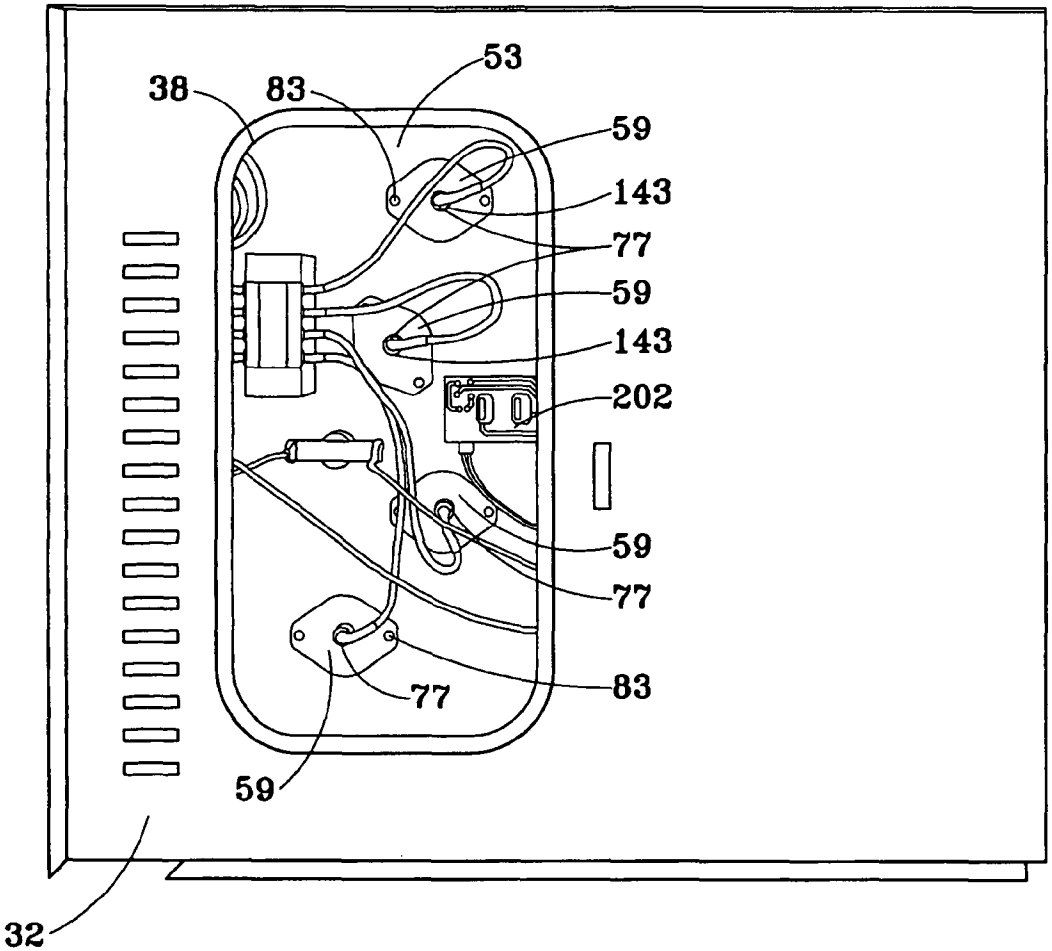
FIG. 11 is an enlarged, elevational view of the right side of the heat exchanger assembly and of a portion of the right side of the "Z"-shaped box within.

The first, left side 51 of the "Z"-shaped box 92 has a first set of four, circular tube mount openings 140 dimensioned to receive and support the mounting portions 124 of the electrical connector blocks 120. The second, right side 53 of the box 92 has a corresponding second set of four, circular tube mount openings 142 that are laterally and oppositely-disposed with respect to the openings 140. The openings 142 are each large enough to permit passage of a quartz heater tube assembly 70 therethrough. For each opening 142, a mounting plate 59 is provided that is reversibly attachable to the second, right side of the box 92 by two machine screws 83 and, when attached, completely covers the opening 142. Each mounting plate 59 has a circular mounting aperture 143 dimensioned to receive and support a shank extension 77 of a second ceramic insulator 76 of a quartz heater tube assembly 70. Accordingly, with a block 120 mounted within a mounting opening 140 of the first, left side 51 of the heat exchanger assembly 16, with the second, right side of the heat exchanger assembly 16 exposed as depicted in FIG. 11, and with a mounting plate 59 removed from an opening 142 disposed opposite said opening 140, a quartz heater tube assembly 70 can be passed through said opening 142 and mounted within the "Z"-shaped box 92 by pressing the shank extension 77 of the first ceramic insulator 74 against the head portion 130H to force the sliding contact 130 to the retracted position, inserting the shank extension 77 of the second ceramic insulator 76 into a tube mount aperture 143 of the removed mounting panel 59, attaching the mounting plate 59 with screws 83 flush against an exterior surface of a second side 53 of the box 92, thereby causing the slidable contact 130 to retract and the block compression spring 132 to compress. Once a quartz heater tube assembly 70 is installed within the box 92 in this manner, an electrically conductive path is established comprising the pin 81 of the second ceramic insulator 76, the filament 90, the pin 81 of the first ceramic insulator 74, the sliding contact 130, and the female wire connector 131. Thereafter, said assembly 70 can be dismounted and removed from the system by disattaching the mounting plate 59 from the second side 53 of said box 92, thereby permitting the block compression spring 132 to urge the sliding contact 130 back to an extended position, and then removing the shank extension 77 of the first ceramic insulator 74 from the mount opening 140 of the first side 51 of said box 92, whereupon the entire quartz heater tube assembly 70 can be withdrawn from the "Z"-shaped box through the opening 142 and then withdrawn from the heat exchanger assembly 16 through the utility access cutout 38.

Each quartz heater tube assembly 70 includes a helical fin 84 coaxial with, and wound around, the quartz tube 72, and the fin preferably has about one helical turn per 0.7 centimeter length of the tube. A first end 84' of the fin 84 is attached to a ceramic lug 86 on the first ceramic insulator 74, and the fin extends to an opposite, second end 84" that is attached to a ceramic lug 86 on the second ceramic insulator 76. The fin 84 is fabricated from stainless sheet steel and has a plurality of helically spaced-apart depressions 88 disposed along substantially the entire extent of the fin for disrupting the flow of air as it passes by the tube 72. The air turbulence thereby created in the vicinity of the tubes 72 when the system is in operating mode improves the heating efficiency of the system.

Figure 12:
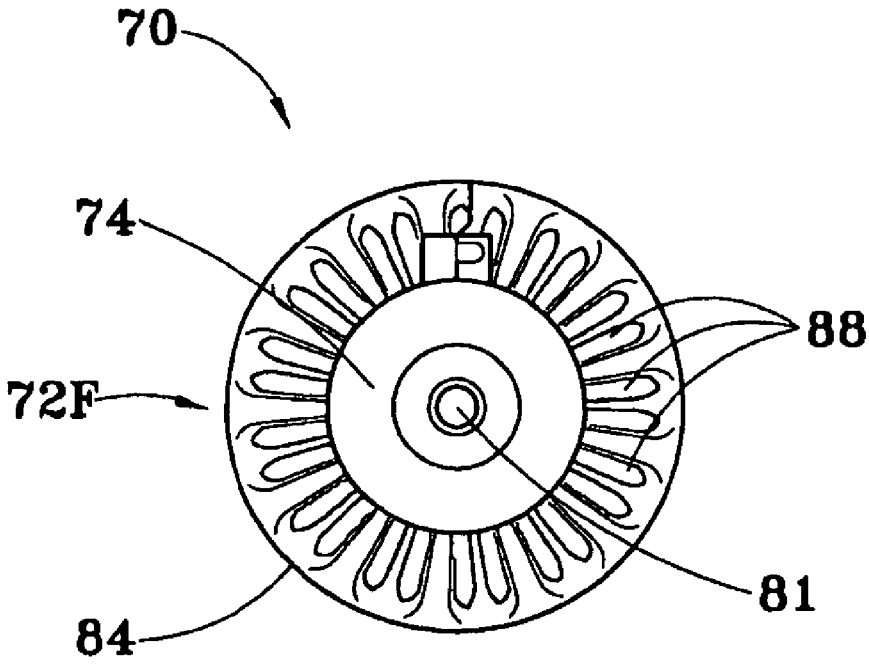
FIG. 12 is a further enlarged, right end view of the quartz tube of FIG. 8, dismounted and removed from the system in order to illustrate the helical sequence of depressions in the helical fin thereof.
Figure 13:
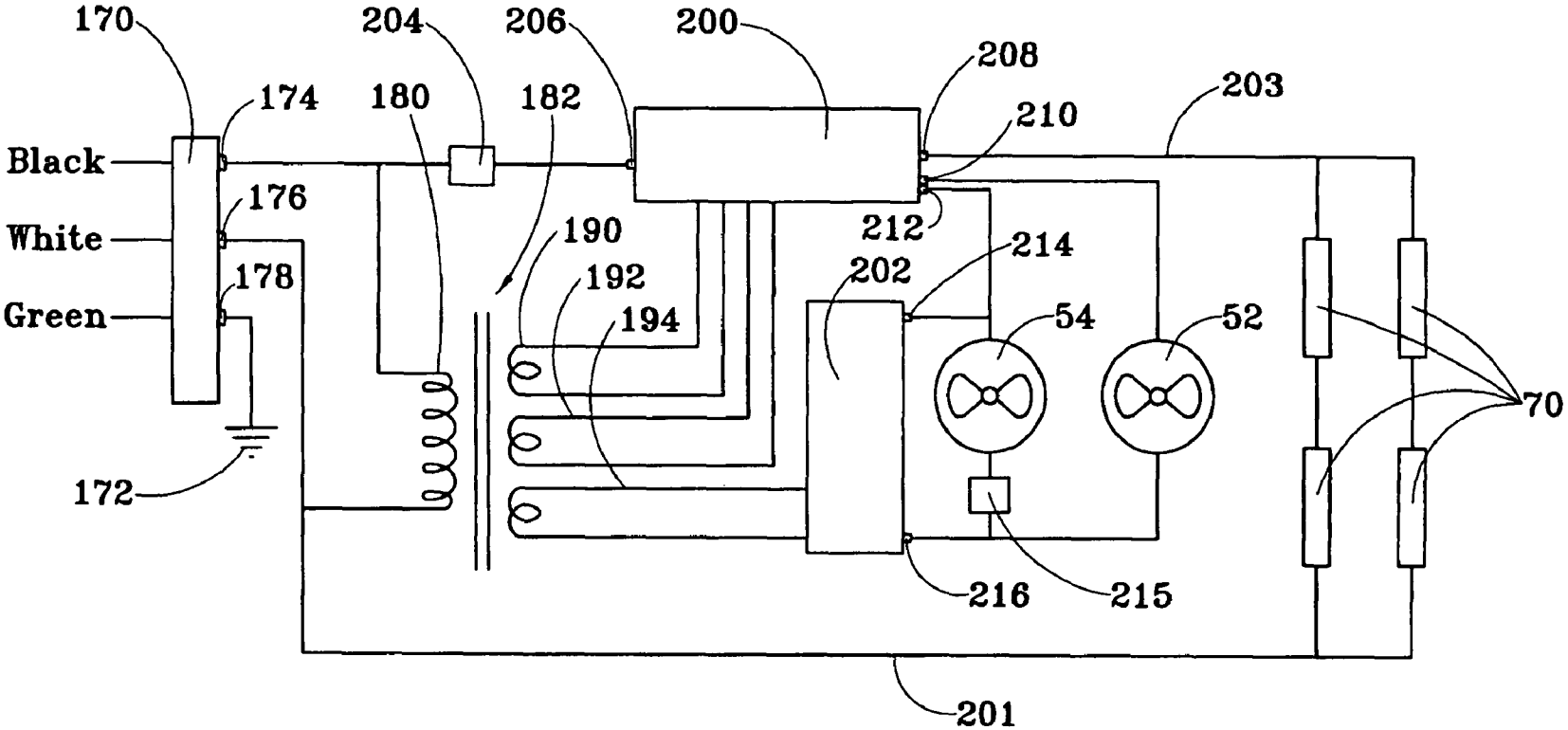
FIG. 13 is an electric circuit schematic for the electric power and control means for the system.

The control panel 36 includes pushbutton controls for the system—namely, a "power" button toggle switch 150 to turn electric power to the system on and off, a "time" button 152 for setting a clock timer for a delayed start, a "temp" button 154 for requesting a display of ambient room temperature, "up" and "down" buttons 156, 158 for raising/lowering the setting for the desired ambient room temperature, and an "Enter" button 160. The control panel 36 further includes a light emitting diode ("L.E.D.") display 162 to indicate whether infrared heat is turned on, the selected ambient room temperature, and whether the system has been set for a delayed start. Attached to a rear surface of the control panel 36 is a first printed circuit board 200 for computing and displaying these functions. Electric power means is provided to energize the system, including means to provide electrical current to the electrical contact means 80, 82 of the ceramic insulators 74, 76 and to the fan assembly 50. Referring to FIG. 12, white and black wires of the power cord 46 provide 120 volt a.c. current to the primary winding 180 of a step-down, power transformer 182, and a green wire of the power cord 46 is connected to ground 172 through contacts 174, 176 and 178, respectively, of a terminal strip 170. A first secondary winding 190 of the transformer 182 provides 16 volt a.c. current to power the first printed circuit board 200; and a second, secondary winding 192 of the transformer 182 provides 12 volt a.c. current to power the L.E.D. display of the first printed circuit board 200. A third, secondary winding 194 of the transformer 182 provides power to a second printed circuit board 202. A high temperature switch 204 is wired in series with the a.c. contact 174 and a control input contact 206 on the first printed circuit board 200, which switch 204 provides a conductive path to permit 120 volt a.c. current to flow from a first output contact 208 of the board 200 via line 203 through the quartz heater tube assemblies 70 and back to contact 176 of the terminal strip 170 through common line 201, if and only if the temperature sensed by the switch 204 does not exceed a user-selected temperature limit. The second printed circuit board provides direct current through output contacts 214, 216 to operate the first fan 52. The second, direct current fan 54, in series with a fan switch 215, is wired across the output contacts 214, 216 of the second printed circuit board such that an electrically conductive current path through the second fan exists only when the temperature sensed by the switch 214 exceeds a predetermined limit. Details for the printed circuit boards 200, 202 are omitted as their design and construction is within the ability of persons of ordinary skill in the art.

Figure 3:
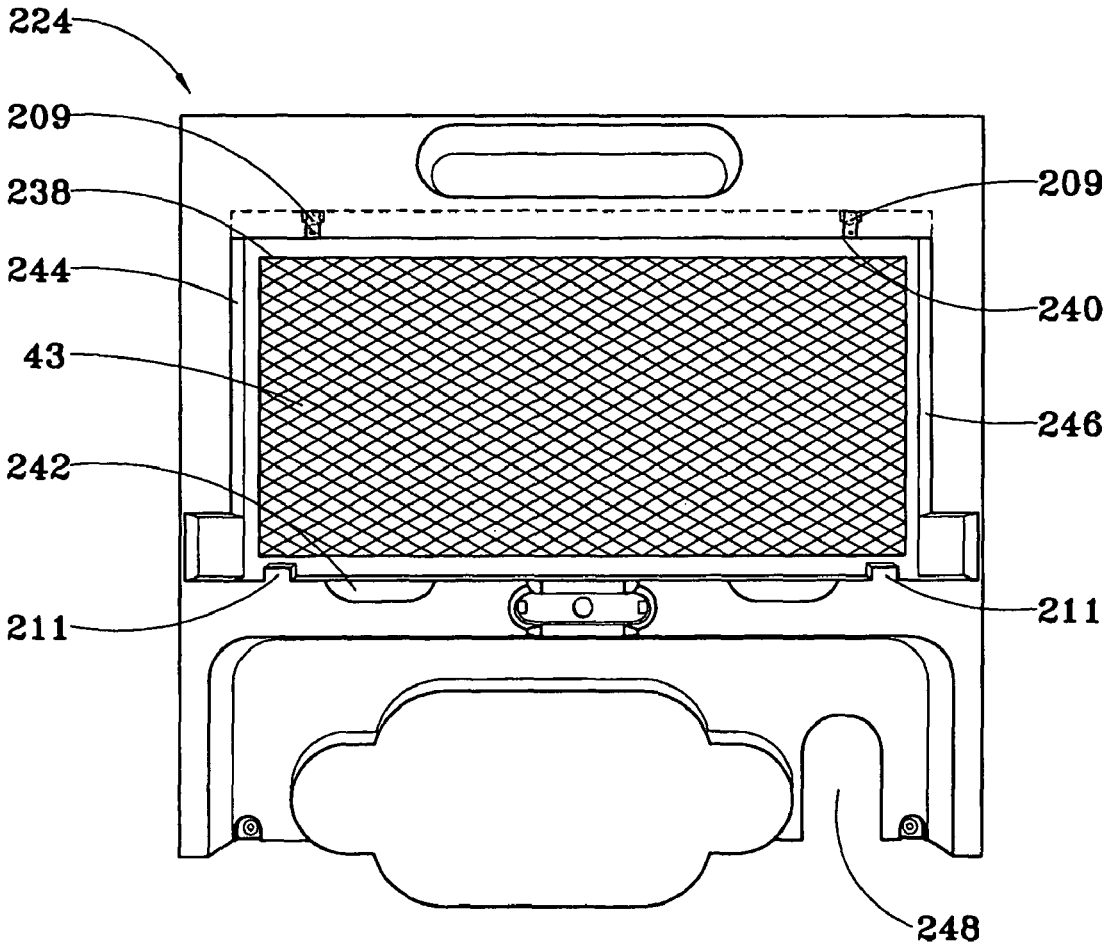
FIG. 3 is a rear elevational view of the rear panel of the beauty box thereof.
Figure 4:
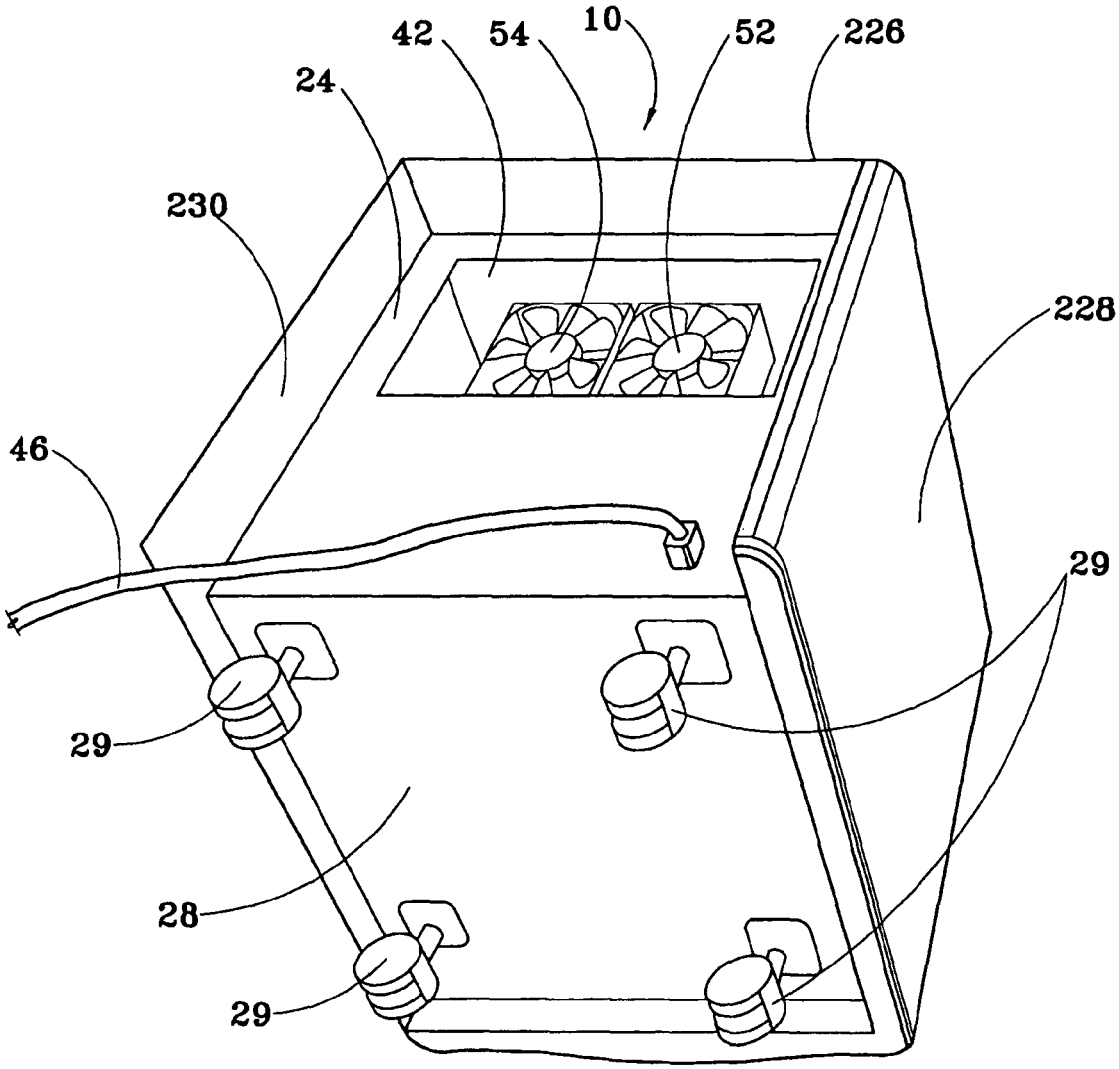
FIG. 4 is a bottom/rear perspective view thereof.
Figure 5:
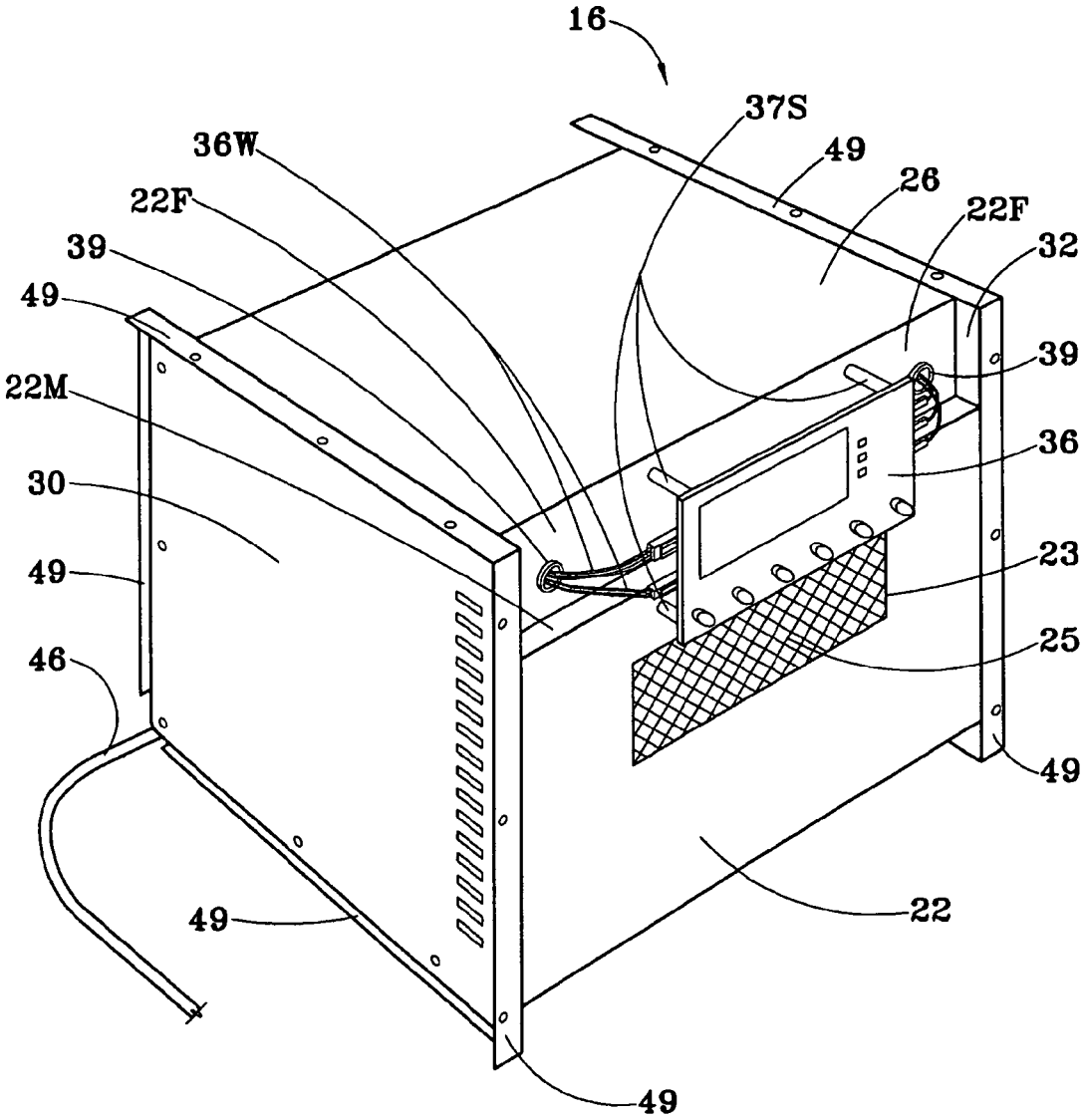
FIG. 5 is a top/front perspective view of the heat exchanger assembly thereof.

A beauty box, denoted generally by the numeral 220, surrounds the heat exchanger assembly 16, except the bottom side 28 thereof. The beauty box 220 includes a front panel 222 and a rear panel 224 joined by a top panel 226, a left side panel 228, and a right side panel 230, which are coextensive with and, when attached to the heat exchanger assembly 16, overlie the front side, rear side, top side, left side, and right side thereof, respectively. Apertured, peripheral flanges 49 are provided for each of said sides of the heat exchanger assembly 16 for attachment of the beauty box panels by machine screws (not shown). The front panel 222 has a control panel access cutout 232 to provide access to the control panel 36 and an air outlet cutout 234, coextensive with the air outlet grill 25, to permit air to exit through the air outlet end 14 of the system. Attached to an interior surface 2301 of the right side panel 230 is a closure member 236 that, when the right side panel 230 is attached to the beauty box 220, is coextensive with the utility access cutout 38 of the second, right side 53 of the heat exchanger assembly 16, in order to block escape of heated air through said cutout when the system is operating. The rear panel 224 has a rectangular, air inlet opening 238, the periphery of which opening is defined by a rectangular, recess frame having a top wall 240 and a bottom wall 242 joined by a left wall 244 and a right wall 246, which walls are dimensioned to receive a replaceable, electrostatic air inlet filter 43 that is coextensive with the frame. The filter 43 is retained within the recess frame by a pair of laterally spaced-apart, compression springs 209 (FIG. 3, phantom outline) that depend from the top wall 240, a pair of laterally spaced-apart, upstanding, retainer lugs 211 that are attached to the bottom wall 242, and an air inlet grill 248 that extends across the air inlet opening 238. The rear panel 224 also has a power cord pass-through cutout 248. Void spaces 91 between the "Z"-shaped box 92 and the left side 30, right side 32, front side 22 and rear side 24 of the heat exchanger assembly 16 help keep the beauty box cool to the touch even when the system is operating and in heating mode. The helical fins 84 are also believed to assist in confining heat generated within the "Z"-shaped box 92 within that box.

Although the invention has been described in connection with a preferred embodiment, it should be understood that the invention as claimed should not be unduly limited to such specific embodiment. Indeed, various modifications of the described mode for carrying out the invention that are obvious to those skilled in design and manufacture of electric space heating systems or related fields are intended to be within the scope of the invention. The copper plates 110, 112 are preferably made of high purity, 22 gauge copper, but may be made of copper alloys that are at least 85 percent by weight copper; accordingly the term "copper" shall be understood to include such copper alloys. Although the system 10 is depicted with the air inlet grill 248 above, and the air outlet grill 25 below, the heat exchanger assembly 16, respectively, the entire system 10 could be inverted so that the air inlet grill is disposed below, and the air outlet grill is disposed above, the heat exchanger assembly; and, so inverted, the system 10 remain the same invention. Similarly, although the first and second sides of the air exchanger assembly, beauty box and mounting panels have all been depicted and described as "left" and "right," respectively, the invention includes an alternative embodiment wherein said first and second sides are instead disposed on the right and on the left of sides of the system, respectively. The system can optionally and advantageously further include another block mounting plate 57 attached by screws 83 to an exterior surface of the first side 51 of the "Z"-shaped box 92, and the plate 57 has a circular opening coaxial with the block 120 and dimensioned to receive and support the mounting portion 124 of the block. The beauty box 220 is preferably made of plastic but may also be made of wood or metal and, except for electrical and electronic components, caster wheels 29, fan assembly, air inlet filter, quartz heater tube assemblies 70 and copper plates 110, 112, the remaining component parts of the system 10 are preferably fabricated from 22 gauge sheet steel. The fans 52, 54 are selected for quiet operation and preferably are low noise axial fans or scroll fans. The resistive filament 90 may be helically-coiled NICHROME® wire, which is available, for instance, from Mor Electric Heating Associates, Inc. of Comstock Park, Ill., but other suitable materials known to persons of ordinary skill in the art may also be used. NICHROME® is a registered trademark of the Driver-Harris Wire Company and relates to alloys of nickel, chromium and iron containing less than 30% iron. The high temperature switch 204 includes a high temperature probe (not shown) that preferably is disposed so as to sense the temperature of a metal extension (not shown) that protrudes from the beauty box 220 no more than 2.5 cm to maintain proper and accurate thermostatic control. Thus, the presently disclosed embodiment is to be considered in all respects as illustrative and not restrictive, the scope of the invention being indicated by the appended claims, and not limited to the foregoing description.

We claim:

1. A quartz heater tube assembly for use in a system for heating air, said system having:

an air inlet end through which air that is to be heated can enter into the system;

an air outlet end through which air that has been heated by the system can exit the system;

means for moving air into, though, and out of the system; and a heat exchanger assembly interposed between, and in communication with, the air inlet end and the air outlet end, said heat exchanger assembly including:

duct means for conducting air through the heat exchanger assembly from the inlet end to the outlet end, thereby defining an airstream path for the flow of air through the system, wherein the duct means includes a "Z"-shaped, hollow box that houses one or more quartz heater tube assemblies;

and said quartz heater tube assemblies laterally disposed with respect to said airstream path within the duct means, each assembly comprising:

a quartz tube, said tube having a first end and an opposite, second end, said tube being translucent to infrared radiation;

a first ceramic insulator adapted to receive and support the first end of the tube, said insulator having a first electrical contact means;

a second ceramic insulator adapted to receive and support an opposite, second end of the tube, said insulator having a second electrical contact means;

means for mounting the first ceramic insulator to the system;

means for mounting the second ceramic insulator to the system;

an electrically-resistive filament that extends through the lumen of the tube from the first electrical contact means to the second electrical contact means, which filament when energized by the passage of electric current therethrough emits infrared radiation through said tube; and means surrounding the tube for inducing air turbulence in the vicinity of the tube when the system is energized and operating.

2. The assembly of claim 1, wherein the means for creating air turbulence in the vicinity of the tube comprises a helical fin that is wound about, and coaxial with, said tube, said fin having opposite ends attached to the first and second ceramic insulators, respectively, and a plurality of helically spaced-apart depressions disposed along substantially the entire extent of the fin for disrupting the flow of air as it passes by said tube.

3. The assembly claim 2, wherein the helical fin is comprised of stainless steel.

4. The assembly of claim 3, wherein the filament comprises an electrically-resistive, helical coil.

5. The assembly of claim 4, wherein the first and second ceramic insulators have oppositely-directed first and second shank extensions, said first and second shank extensions having embedded, electrically-conductive first and second contact pins, said pins having oppositely-directed first ends attached to the electrical filament and opposite, second ends; and the means for mounting the first and second ceramic insulator includes said shank extension of said first and second ceramic insulators, respectively.

6. The assembly of claim 5, wherein the means for mounting the first ceramic insulator further comprises a ceramic electrical connector block, said block including a body, said body having a socket portion and an oppositely-directed mounting portion, and a bore that extends through the socket and mounting portions;

a spring stop within the bore;

a slidable, electrical contact that is movable between a retracted position and an extended position within the bore;

a block compression spring that is interposed between the slidable contact and the spring stop within the bore, which spring urges the slidable contact toward the extended position; and and an electrical male connector tab, said tab having a first end disposed within the bore of the block and attached to the slidable contact, and a second, opposite end, said second end having a tab extension adapted for insertion into a female electrical wire connector.

7. A system for heating air, said system comprising:

an air inlet end through which air that is to be heated can enter into the system;

an air outlet end through which air that has been heated by the system can exit the system;

a heat exchanger assembly interposed between, and in communication with, the air inlet end and the air outlet end, said heat exchanger assembly including:

duct means for conducting air through the heat exchanger assembly from the inlet end to the outlet end, thereby defining an airstream path for the flow of air through the system, wherein the duct means includes a "Z"-shaped, hollow box that houses one or more quartz heater tube assemblies; and said quartz heater tube assemblies laterally disposed with respect to said airstream path within the duct means, each assembly comprising:

a quartz tube, said tube having a first end and an opposite, second end, said tube being translucent to infrared radiation;

a first ceramic insulator adapted to receive and support the first end of the tube and having a first electrical contact means;

a second ceramic insulator adapted to receive and support the second end of the tube and having a second electrical contact means;

means for mounting the first ceramic insulator to the heat exchanger assembly;

means for mounting the second ceramic insulator to the heat exchanger assembly;

an electrical filament that extends through the lumen of the tube from the first electrical contact means to the second electrical contact means, which filament when energized by the passage of electric current therethrough emits infrared radiation through said tube and into the airstream path;

means surrounding the tube for inducing air turbulence in the vicinity of the tube when the system is energized and operating;

means for drawing air into, through, and out of the system; and electric power means to energize the system, said means including means to provide electrical current to the electrical contact means of the ceramic insulators and to the means for drawing air into, though, and out of the system.

8. The system of claim 7, wherein the means for creating air turbulence in the vicinity of the tube comprises a helical fin that is wound about, and coaxial with, said tube, said fin having a plurality of helically spaced-apart depressions disposed along substantially the entire extent of the fin for disrupting the flow of air as it passes by said tube.

9. The system of claim 8, wherein the helical fin is comprised of stainless steel.

10. The system of claim 9, wherein the electrical filament comprises an electrically-resistive, helical coil.

11. The system of claim 10, wherein the means for drawing air into, through, and out of the system comprises an electrical fan assembly.

12. The system of claim 11, wherein the electrical fan assembly is disposed at the air inlet end of the system.

13. The system of claim 12, wherein the heat exchanger assembly includes spaced-apart front and rear sides joined by top, bottom, and first and second laterally spaced-apart sides, respectively, said front side having an air outlet cutout, said second side having a utility access cutout, and said rear side having an air inlet cutout and an electric power cord pass-through opening.

14. The system of claim 13, wherein the duct means includes a "Z"-shaped, hollow box that houses said quartz heater tube assemblies, said box having a front side with an entrance opening adjacent to and in communication with the fan assembly and a rear side with an exit opening adjacent to and in communication with the air outlet end of the system, and said box further including a first side and a laterally spaced-apart second side and a plurality of interior surfaces that join the first side and second side thereof and that in combination define a "Z"-shaped airstream pathway, said interior surfaces including at least one air deflector surface interposed between the one or more quartz tubes and the fan assembly to shield the fan assembly from direct infrared radiation from the tubes.

15. The system of claim 14, wherein the first and second ceramic insulators have oppositely-directed first and second shank extensions, respectively, and the first and second electrical contact means include first and second electrically-conductive, contact pins embedded within said first and second shank extensions, respectively, said pins having oppositely-directed first ends attached to opposite ends of the electrical filament, and said pins each having opposite, second ends.

16. The system of claim 15, wherein the first side of the "Z"-shaped box has a plurality of first tube mount openings and the second side of said box has a corresponding plurality of second tube mount openings that are oppositely and laterally disposed with respect to the first tube mount openings, the number of first and second tube mount openings each being at least as many as the number of quartz tubes within said "Z"-shaped box;

the means for mounting the first ceramic insulator includes a ceramic electrical connector block, said block including a body that comprises a socket portion and an oppositely-directed mounting portion, said body having a bore that extends through the socket and mounting portions, and said mounting portion being dimensioned to be insertable into, and supported by, any of said first tube mount openings;

a spring stop within the bore;

a slidable, electrical contact that is movable between a retracted position and an extended position within said bore;

a block compression spring that is interposed between the slidable contact and the spring stop within the bore, which spring urges the slidable contact toward the extended position; and an electrical male connector tab, said tab having a first end disposed within the bore of the block and attached to the slidable contact, and having an opposite, second end, said second end including a tab extension adapted for insertion into a female electrical wire connector;

the means for mounting the second ceramic insulator includes a mounting plate dimensioned to cover the tube mount opening of the second side of the "Z"-shaped box and attachable thereto, said plate having a tube mount aperture; and said shank extension of said second ceramic insulator, which extension is dimensioned to be insertable into, and supported by, the aperture of the mounting plate;

whereby, a quartz heater tube assembly can be installed within the system by removing a mounting panel from the second side of the "Z"-shaped box, thereby exposing a tube mount opening therein;

passing said assembly through the utility access cutout and through said tube mount opening;

inserting the shank extension of the first ceramic insulator thereof into the socket portion of a block that is mounted to a first wall of said box opposite said tube mount opening and wired to the electric power means;

attaching said mounting plate flush against an exterior surface of the second side of said box, thereby causing the slidable contact to retract and the block compression spring to compress;

and connecting the second end of the pin of the second ceramic insulator to the electric power means; and whereby said quartz heater tube assembly can thereafter be removed from the system by disconnecting the electric power means from the second end of the pin embedded within the shank extension of the second ceramic insulator of said assembly;

disattaching the mounting plate from the second side of said box, thereby exposing said tube mount opening and permitting the block compression spring to urge the sliding contact back to an extended position;

removing the shank extension of the first ceramic insulator from the socket portion of the electrical connector block that is mounted oppositely to the first side of said box; and then withdrawing the quartz heater tube assembly from the "Z"-shaped box through said tube mount opening and from the heat exchanger assembly through the utility access cutout.

17. The system of claim 16, further comprising at least one copper plate disposed within the Z-shaped box and downstream from the one or more quartz heater tube assemblies in order to further heat the air.

18. The system of claim 17, further comprising a deflector plate attached to the heat exchanger assembly at the air outlet end of the system for directing heated, exiting air away from the system.

19. The system as in any of claims 7-18, wherein the means for drawing air into, through, and out of the system further includes control panel means, wired to the electric power means, for powering up and powering down the system, sensing, controlling and displaying the temperature of air within the airstream path, and for controlling the electric fan assembly, said means including a control panel having manually-actuable controls.

20. The system of claim 19, further comprising a beauty box, said beauty box including a front panel that is mountable to, and coextensive with, the front side of the heat exchanger assembly, said front panel having a control panel access cutout to provide access to the control panel and an air outlet cutout to permit air to exit through the air outlet end of the system;

a top panel that is coextensive with, and attachable to, the top side of the heat exchanger assembly;

a first side panel that is coextensive with, and attachable to, the first side of the heat exchanger assembly;

a second side panel that is coextensive with, and attachable to, the second side of the heat exchanger assembly, said panel having a closure member attached to an interior surface thereof that, when said panel is attached to the heat exchanger assembly is coextensive with the utility access cutout of the second side of the heat exchanger assembly in order to prevent escape of heated air through said cutout when the system is operating; and a rear panel that is coextensive with, and attachable to, a rear side of the heat exchanger assembly, said rear panel having an air inlet opening and including means for mounting a replaceable, inlet air filter over said air inlet opening.

21. The system of claim 20, wherein the rear panel has an exterior surface and an opposite, interior surface, and a recess frame surrounds the air inlet cutout opening thereof, said recess frame including top, bottom, left and right recess surfaces, and the means for mounting a replaceable air filter to the rear panel of the beauty box includes an air inlet grill that is coextensive with the inlet air filter, attached to said recess surfaces, and recessed from the exterior surface of said panel, and the rear panel further includes a pair of laterally spaced-apart compression springs that depend from said top recess surface, and a pair of laterally spaced-apart, upstanding lugs attached to the bottom recess surface of said recess frame adjacent to the rear surface of the rear panel;

whereby an air filter may be installed by pressing an upper portion of the filter against the springs and inserting a lower portion of the filter between the lugs and the air inlet grill, and the filter may thereafter be removed by pressing the filter upward to compress the springs and then withdrawing the lower portion of the filter away from the lugs and the air inlet grill.

* * * * *